United States Patent [19]

Apprille, Jr.

[11] Patent Number: 5,050,301

[45] Date of Patent: Sep. 24, 1991

[54] RAZOR ASSEMBLY

[75] Inventor: Domenic V. Apprille, Jr., Arlington, Mass.

[73] Assignee: The Gillette Company, Boston, Mass.

[21] Appl. No.: 585,259

[22] Filed: Sep. 19, 1990

[51] Int. Cl.[5] ..... B26B 21/14; B26B 21/16; B26B 19/00; B26B 19/28

[52] U.S. Cl. ..... 30/87; 30/89; 30/43.3; 30/42

[58] Field of Search ..... 30/43.3, 42, 47, 50, 30/53, 57, 85, 87, 89, 32

[56] References Cited

U.S. PATENT DOCUMENTS

| | | | |
|---|---|---|---|
| 2,748,470 | 6/1956 | Borden | 30/89 |
| 3,396,464 | 8/1968 | Treiss | 30/87 |
| 3,593,416 | 7/1971 | Edson | 30/50 |
| 3,935,639 | 2/1976 | Terry et al. | 30/87 |
| 3,938,247 | 2/1976 | Carbonell | 30/47 |
| 3,950,849 | 4/1976 | Perry | 30/47 |
| 4,026,016 | 5/1977 | Nissen | 30/47 |
| 4,083,104 | 4/1978 | Nissen et al. | 30/47 |
| 4,159,567 | 7/1979 | Chen et al. | 30/62 |
| 4,184,246 | 1/1980 | Trotta | 30/47 |
| 4,245,389 | 1/1981 | Trotta | 30/47 |
| 4,270,268 | 6/1981 | Jacobson | 30/47 |
| 4,403,412 | 9/1983 | Trotta | 30/47 |
| 4,483,068 | 11/1984 | Clifford | 30/49 |
| 4,573,266 | 3/1986 | Jacobson | 30/87 |
| 4,587,729 | 5/1986 | Jacobson | 30/41 |
| 4,709,477 | 12/1987 | Ferraro | 30/50 |
| 4,756,082 | 7/1988 | Apprille, Jr. | 30/89 |
| 4,774,765 | 10/1988 | Ferraro | 30/50 |
| 4,785,534 | 11/1988 | Lazarchik | 30/89 |
| 4,791,724 | 12/1988 | Dumas | 30/89 |
| 4,807,360 | 2/1989 | Cerier et al. | 30/49 |

*Primary Examiner*—Douglas D. Watts
*Assistant Examiner*—Paul M. Heyrana, Sr.
*Attorney, Agent, or Firm*—Lorusso & Loud

[57] ABSTRACT

A razor assembly of the wet-shave type comprising a razor handle, a head portion extending from the razor handle, the head portion having therein a cavity therein. A spring retention chamber disposed in the handle portion, and a spring member comprising a foot portion retained by the spring retention chamber, a stem portion connected at a first end to the foot portion, the stem portion extending from the foot portion toward the head portion, a flange portion fixed to a second end of the stem portion, and blade assembly connector structure on the flange portion, said connector structure being connected to a blade assembly disposed in the cavity, the spring member being adapted to facilitate pivotal movement of the blade assembly during a shaving operation, the spring member being operative to urge the blade assembly to a neutral position in the razor head cavity.

21 Claims, 2 Drawing Sheets

RAZOR ASSEMBLY

BACKGROUND OF THE INVENTION

1. Field of the Invention

This invention relates to wet-shave type razors and is directed more particularly to a razor in which the blade assembly portion thereof is adapted for movement during a shaving operation to conform to the surface being shaved.

2. Description of the Prior Art

It is known in the art that shaving efficiency of a safety razor assembly may be improved if the blade assembly is adapted to pivot on the razor handle during a shaving operation, permitting the blade assembly to more closely follow the contours of a surface being shaved. U.S. Pat. No. 3,935,639, issued Feb. 3, 1976, in the name of John C. Terry et al., and U.S. Pat. No. 3,938,247, issued Feb. 17, 1979, in the name of Nelson C. Carbonell, et al., are illustrative of razor handles adapted to accept blade assemblies in such a manner as to permit pivotal movement of the blade assembly during a shaving operation. U.S. Pat. No. 3,950,849, issued Apr. 20, 1976, in the name of Roger L. Perry, illustrates a blade assembly adapted for pivotal movement. U.S. Pat. No. 4,026,016, issued May 3, 1977, in the name of Warren I. Nissen. and U.S. Pat. No. 4,083,104, issued Apr. 11, 1978, in the name of Warren I. Nissen, illustrate, respectively, a blade assembly and razor handle comprising a shaving system in which the blade assembly pivots on the handle during shaving.

In the above-mentioned razors, the pivoting action takes place about a given axis, limiting the accommodation which the blade assembly may make to the surface being shaved.

SUMMARY OF THE INVENTION

It is an object of the present invention to provide a razor having facility for mounting thereon a blade assembly, such that the blade assembly may pivot along a multiplicity of axes in conforming to a surface being shaved.

With the above and other objects in view, as will hereinafter appear, a feature of the present invention is the provision of a razor assembly of the wet-shave type comprising a razor handle, a head portion extending from the razor handle, the head portion having therein a cavity with a hemispherically shaped bottom portion, spring retention means disposed in the razor handle, and spring means, the spring means comprising a foot portion retained by the spring retention means, a stem portion connected at a first end to the foot portion, the stem portion extending from the foot portion toward the head portion, a flange portion fixed to a second end of the stem portion and shaped complementarily to the cavity bottom portion, and connector means on the flange portion for connecting the flange portion of the spring means to a blade assembly, the spring means being adapted to facilitate pivotal movement of the blade assembly during a shaving operation and being operative to urge the blade assembly to a neutral position in the razor head cavity.

The above and other features of the invention, including various novel details of construction and combinations of parts, will now be more particularly described with reference to the accompanying drawings and pointed out in the claims. It will be understood that the particular device embodying the invention is shown by way of the principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 2:
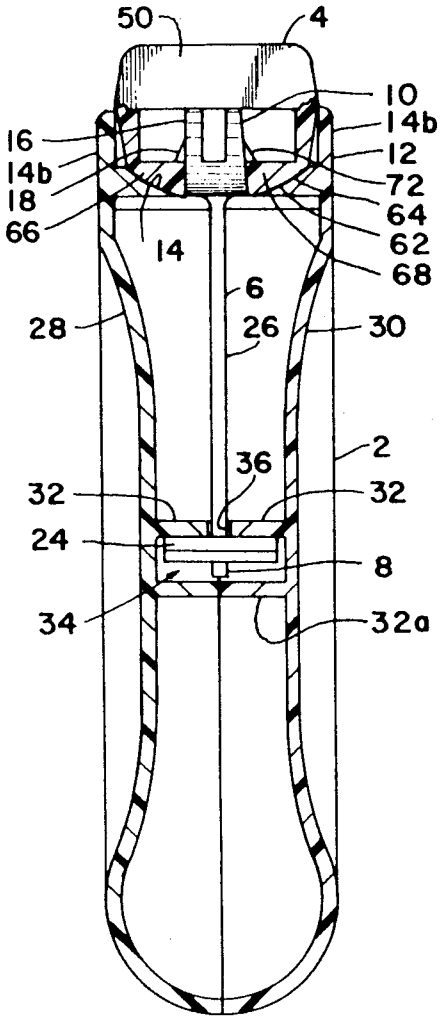
FIG. 2 is a side sectional view of the razor.

Referring to the drawings, it will be seen that the illustrative razor assembly includes a razor handle 2, a blade assembly 4, and a spring member 6. The spring member 6 is anchored at a first end 8 and connected to the blade assembly 4 at a second end 10 thereof.

Figure 1:
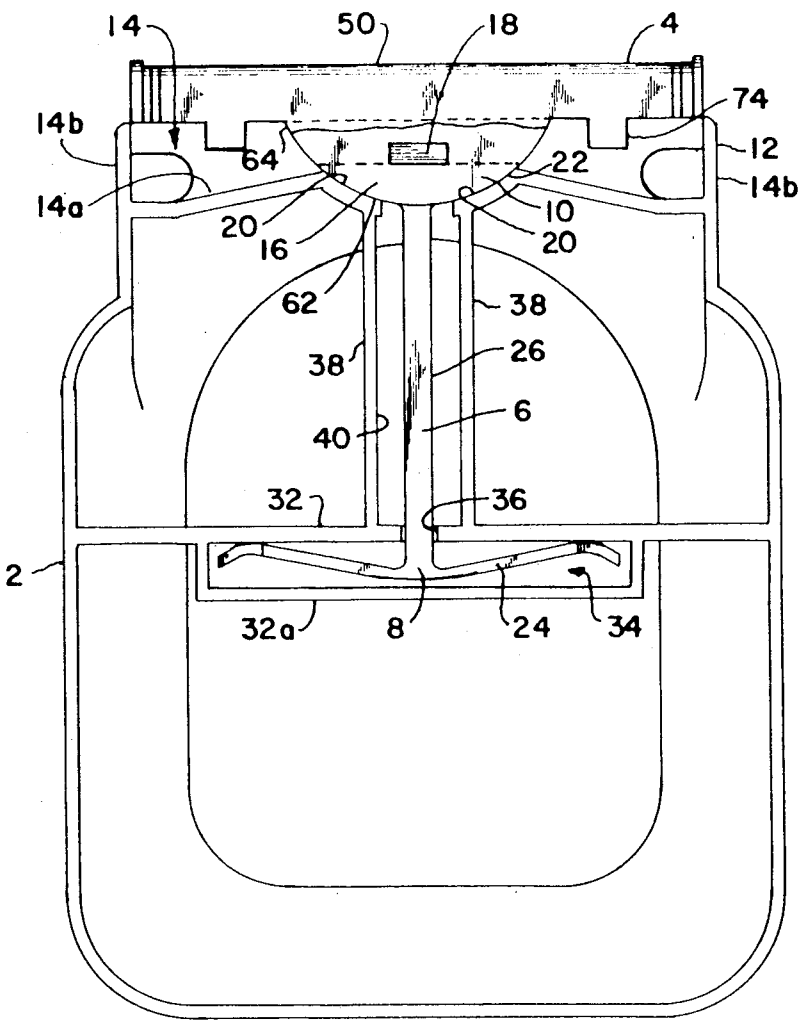
FIG. 1 is an elevational view of one form of razor illustrative of an embodiment of the invention, with one of the handle housing portions removed to view the interior components of the razor.

The razor handle 2 includes a head portion 12 having a cavity 14 therein. The cavity 14 is defined by a floor wall 14*a* and upstanding walls 14*b*. The spring member 6 includes a rounded flange portion 16 at the second end 10 thereof, the flange portion 16 being provided with blade assembly connector means 18 (FIGS. 2 and 3), which may be detents, operative to engage and retain the blade, assembly 4 (FIG. 2), as will be further described hereinbelow. The cavity 14 is provided with a rounded or hemispherically-shaped bottom portion 20 and the flange portion 16 has a complementarily shaped surface 22 (FIG. 1).

The spring member 6 includes a foot portion 24 at the first end 8 of the spring member. The foot portion 24 extends transversely of a stem portion 26 which interconnects the foot portion 24 and the flange portion 16 of the spring member. The foot portion 24 of the spring member 6 is anchored in the razor handle 2, as will be further described hereinbelow. The foot portion 24 may comprise a leaf spring, as illustrated in the drawings, connected at a central point to the stem portion 26 of the spring member.

The handle 2 preferably comprises first and second formed portions 28, 30 (FIG. 3) connected together with the spring member 6 therebetween to form the razor handle (FIG. 2). Each of the formed portions 28, 30 is provided with walls 32, 32*a* molded integrally therewith which, upon joining of the two formed portions with the spring member therebetween, adjoin to form a chamber 34 (FIGS. 1 and 2) which substantially encloses the foot portion 24 of the spring member 6 to serve as a spring retention means and anchor the spring member in the handle. The chamber 34 is provided with an opening 36 through which extends the stem portion 26 of the spring member 6. Alternatively, the single widthwise wall 32 may be disposed between the foot portion 24 and the head portion 12 and serve as a spring retention means.

The two formed portions 28, 30 are also provided with walls 38 which adjoin to form a compartment 40 (FIG. 1) which extends from around the opening 36 to an underside of the bottom portion 20 of the cavity 14. The spring means stem portion 26 is disposed in the compartment 40.

Preferably, the entire spring member 6, including the foot portion 24, the stem portion 26, the rounded flange portion 16, and the blade assembly connector means 18, is a single, unitary, molded plastic member. Preferably, the two handle formed portions 28, 30 are of molded plastic with the aforementioned walls 32, 38 being molded integrally therewith.

Figure 4:
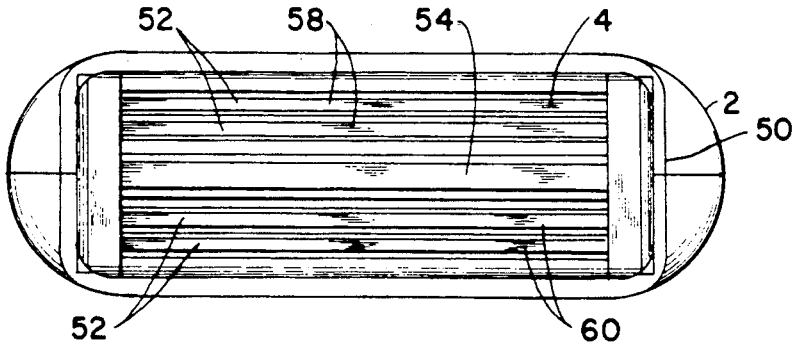
FIG. 4 is top plan view of the razor.

While the above-described handle assembly is adapted to cooperate with blade assemblies of various constructions, one blade assembly found to be suited for use with the handle includes a body portion 50, blade means 52 mounted on the body portion (FIG. 4), and guard means 54 mounted centrally of the body portion. In the embodiment illustrated, each blade of the blade means is independently movable during a shaving operation. The manner in which the blades are mounted for individual and independent movement is fully described in U.S. Pat. No. 4,270,268, issued June 2, 1981, in the name of Chester F. Jacobson. An alternative embodiment is disclosed in U.S. Pat. No. 4,403,412, issued Sept. 13, 1983, in the name of Robert A. Trotta.

In the embodiment shown in the drawings, the blade means 52 comprises a first set of two blades 58 and a second set of two blades 60, the first and second sets of blades 58,60 having their cutting edges extending in opposite directions and toward the guard means 54.

The blade assembly body portion 50 is provided with a ball means 62 having a rounded undersurface 64 shaped complementarily to the handle bottom portion 20. The ball means 62 includes opposed first and second ball portions 66,68 defining therebetween a slot 70, the slot 70 being adapted to lockingly receive the spring flange portion 16. The flange portion 16 is provided with detents 72 on either side thereof for engagement with the first and second ball portions 66,68 (FIG. 2). The flange portion 16 preferably is U-shaped, as shown in FIG. 2, to provide springiness which will allow the detents 18 to pass through the slot 70 and engage the ball portions 66,68 during assembly.

In the course of a shaving operation, the above-described razor assembly is such as to allow the blade assembly to pivot about a multiplicity of axes, the ball means 62 being slidably movable on the handle surface 22. The combination of ball means and spring member permit dynamic movement, of the blade assembly in response to pressures encountered in traversing a surface being shaved.

Figure 3:
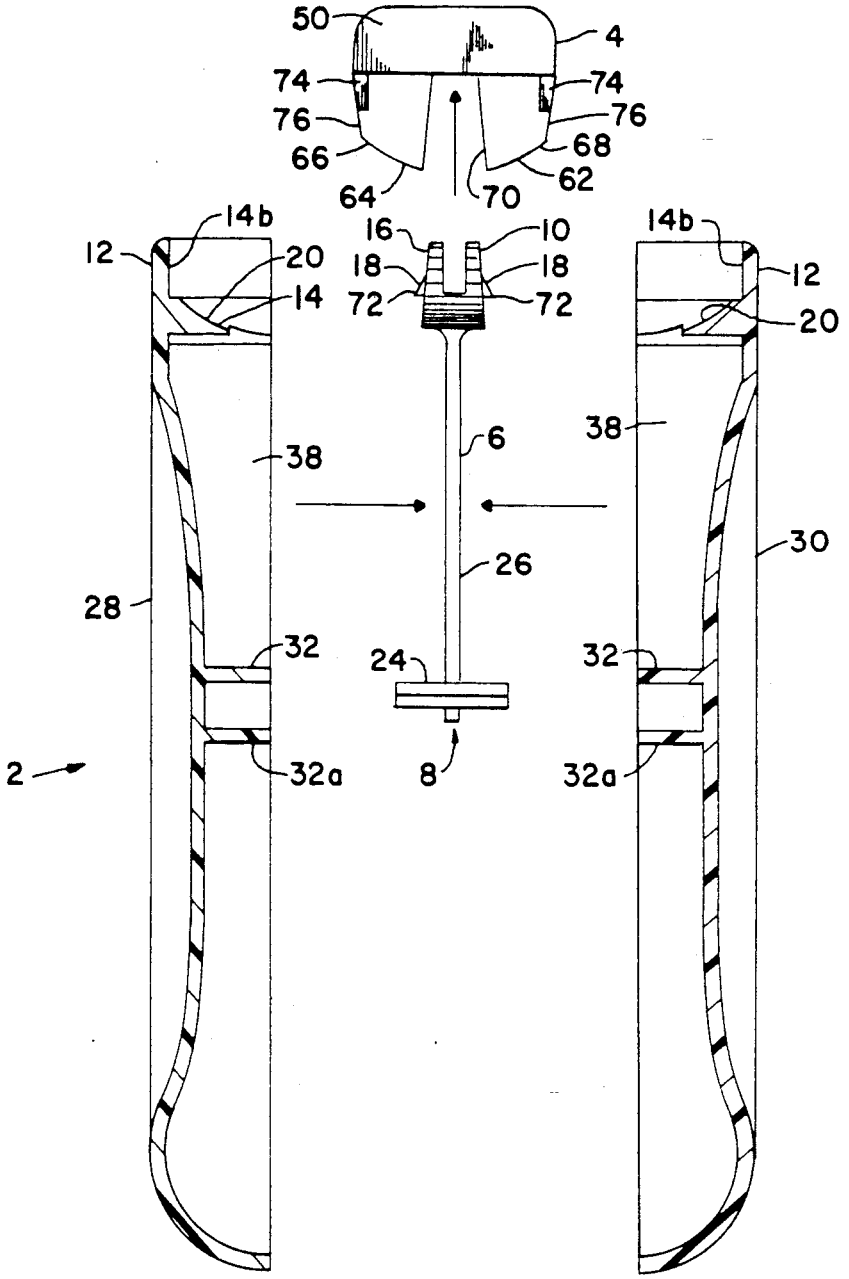
FIG. 3 is similar to FIG. 2, but shows the components in exploded fashion.

Extending from the body portion 50 of the blade assembly 4 are detents 74, which serve as stop means to limit the pivoting movement of the blade assembly. Engagement between a stop means detent 74 and the razor handle cavity floor wall 14*a* (FIG. 1) serves as a positive stop to prevent further pivoting movement in that direction. The detents 74 prevent either end of the blade assembly from receding into the razor handle head too far. In pivoting about a blade assembly lengthwise axis, pivotal movement is limited by the engagement of blade assembly side walls 76 and the upstanding razor handle head cavity walls 14*b* (FIG. 3). The spring member continuously urges the blade assembly into a "neutral" position in the razor head, but permits movement from the neutral position in response to the surface being shaved.

It is to be understood that the present invention is by no means limited to the particular construction herein described and shown in the drawings, but also comprises any modifications or equivalents within the scope of the claims. For example, the blade assembly may be of any selected construction including various arrangements of linear blade edges, as disclosed herein, but also arrangements of disk-shaped blades, as disclosed in U.S. Pat. No. 4,807,360, issued Feb. 28, 1989 in the name of Jeffrey C. Cerier, et al., and foil-type blades, as disclosed in U.S. Pat. No. 4,483,068, issued Nov. 20, 1984, in the name of Glynne E. Clifford.

Having thus described my invention, what I claim as new and desire to secure by Letters Patent of the United States is:

1. A razor assembly of the wet-shave type comprising a razor handle, a head portion extending from said razor handle, said head portion having therein a cavity with a hemispherically shaped bottom portion, spring retention means disposed in said razor handle, and spring means comprising a foot portion retained by said spring retention means, said foot portion comprising a leaf spring portion, a stem portion connected at a first end to a central point on said leaf spring portion, said leaf spring portion extending transversely of said stem portion, said stem portion extending from said foot portion toward said head portion, a flange portion extending from a second end of said stem portion, and blade assembly connector means on said flange portion adapted for attachment to a blade assembly, said spring means being adapted to facilitate pivotal movement of said blade assembly during a shaving operation, said spring means being operative to urge said blade assembly to a neutral position in said razor head cavity.

2. The razor assembly in accordance with claim 1 wherein said connector means comprises detents extending from said flange portion.

3. The razor assembly in accordance with claim 1 in which said spring member foot portion is distinct from and anchored in said handle.

4. The razor assembly in accordance with claim 1, in which said spring retention means comprises a chamber disposed in said razor handle and substantially enclosing said leaf spring portion.

5. The razor assembly in accordance with claim 4, in which said chamber is provided with an opening therein, and said spring means stem portion extends through said opening.

6. The razor assembly in accordance with claim 5, in which a compartment extends from around said opening to an underside of said bottom portion of said cavity, and said spring means stem portion is disposed in said compartment.

7. The razor assembly in accordance with claim 6 in which said razor handle comprises two formed portions joined to form said handle, said portions having walls formed integrally therewith for forming said chamber, said compartment, and said bottom portion.

8. The razor assembly in accordance with claim 7 in which said two portions are molded and said walls are molded integrally therewith.

9. The razor assembly in accordance with claim 1, in which said spring means leaf spring portion, stem portion, flange portion and blade assembly connector means comprise a single, unitary member.

10. The razor assembly in accordance with claim 9, in which said unitary member is of molded plastic.

11. The razor assembly in accordance with claim 1 including said blade assembly, said blade assembly comprising a body portion, blade means mounted on said body portion, and means thereon for receiving said blade assembly connector means on said flange portion of said spring means for connecting said blade assembly to said razor handle.

12. The razor assembly in accordance with claim 1, in which said spring retention means comprises a wall extending widthwise of said handle and between said leaf spring portion and said handle head portion.

13. The razor assembly in accordance with claim 12, in which said wall is provided with an opening therein, and said spring means stem portion extends through said opening.

14. A razor assembly in accordance with claim 1 in which said blade assembly comprises a body portion, and blade means mounted on said body portion, said body portion having as an integral part thereof hemispherically shaped ball means adapted for seating in and multi-directional pivotal movement in said concavity in said razor handle, said ball means including opposed first and second ball portions defining a slot therebetween, said slot being adapted to lockingly receive said second end of said spring member.

15. The razor assembly in accordance with claim 14 in which said spring member is provided with a flange portion at said second end of said spring member, said flange portion having detents on either side thereof for engagement with said first and second ball portions with said flange portion disposed in said slot to lock said spring member second end to said blade assembly ball means.

16. The razor assembly in accordance with claim 15 in which said flange portion is U-shaped and one of said detents is disposed on an outboard surface of each leg of said U-shaped flange portion, such that said flange portion incorporates springiness sufficient to permit said detents to pass through said slot and engage said first and second ball portions during assembly of said razor.

17. A razor handle for a razor assembly of the wet-shave type, said handle comprising a connector means, for a blade assembly having a ball means with rounded undersurface shaped complementary to a handle bottom surface, and a spring member, said spring member being distinct from said handle and anchored at a first end in said handle, said spring members having at a second end thereof said blade assembly connector means adapted to fasten a blade assembly to said spring member to allow the blade assembly to pivot about a multiplicity of axes.

18. A razor handle in accordance with claim 17 wherein said handle includes a head portion having a hemispherically shaped cavity therein, said spring member includes a flange portion at said second end thereof, said blade assembly connector means being disposed on said flange portion.

19. A razor handle in accordance with claim 18 in which said spring member includes a foot portion at said first end thereof, said foot portion extending transversely of a stem portion of said spring member, said foot portion distinct from and being anchored in said razor handle.

20. A razor handle in accordance with claim 19 in which said spring member stem portion interconnects said foot portion and said flange portion.

21. A blade assembly comprising a body portion, and blade means mounted on said body portion, said body portion having as an integral part thereof a hemispherically shaped ball means adapted for seating in and multi-directional pivotal movement in a complementarily shaped concavity in a razor handle, said ball means including opposed first and second ball portions defining a slot therebetween, said slot being adapted to lockingly receive a flange portion of a spring member anchored in said handle.

* * * * *